US007845386B2

(12) United States Patent
Coleman et al.

(10) Patent No.: US 7,845,386 B2
(45) Date of Patent: Dec. 7, 2010

(54) MOVABLE PARTITIONS, COMPONENTS FOR MOVABLE PARTITIONS AND RELATED METHODS

(75) Inventors: W. Michael Coleman, Salt Lake City, UT (US); E. Carl Goodman, Bountiful, UT (US)

(73) Assignee: Won-Door Corporation, Salt Lake City, UT (US)

( * ) Notice: Subject to any disclaimer, the term of this patent is extended or adjusted under 35 U.S.C. 154(b) by 332 days.

(21) Appl. No.: 11/934,555

(22) Filed: Nov. 2, 2007

(65) Prior Publication Data

US 2008/0105387 A1 May 8, 2008

Related U.S. Application Data

(60) Provisional application No. 60/856,676, filed on Nov. 3, 2006.

(51) Int. Cl.
*E05D 15/26* (2006.01)

(52) U.S. Cl. ..... 160/199; 160/84.01; 160/84.08

(58) Field of Classification Search ..... 160/84.01, 160/84.04, 84.05, 126, 40, 196.1, 199, 84.08, 160/114
See application file for complete search history.

(56) References Cited

U.S. PATENT DOCUMENTS 2,027,992 A 1/1936 Maurer
3,073,383 A * 1/1963 Crick ..... 160/193
3,349,829 A * 10/1967 Dixon ..... 160/40
3,509,934 A 5/1970 Smart
3,628,588 A * 12/1971 Dixon ..... 160/40
4,133,364 A * 1/1979 Smart ..... 160/199
4,357,979 A * 11/1982 Marontate ..... 160/199
4,658,878 A * 4/1987 Williams ..... 160/84.09
5,577,348 A 11/1996 Keller (Continued)

FOREIGN PATENT DOCUMENTS

DE 2755157 6/1979

(Continued)

OTHER PUBLICATIONS

PCT International Search Report and Written Opinion for Application No. PCT/US2007/083520, dated Mar. 25, 2008, 14 pages.

(Continued)

*Primary Examiner*—Blair M. Johnson
(74) *Attorney, Agent, or Firm*—TaskBritt

(57) ABSTRACT

Movable partitions and various components for use with movable partitions are disclosed along with related systems and methods. In one embodiment, a track and trolley system for use with a movable partition is described. In one embodiment, the track and trolley system may include a track having three channels wherein a first partition is suspended from the first channel, a second partition is suspended from the second channel, and a trolley is partially disposed in the third channel and between the first and second channels. Seal components may be used to substantially provide a fluid seal between the partitions and a surface from which the partitions are suspended. The trolley is configured to be longitudinally displaceable along the third channel while maintaining its components within an envelope defined by the seal components. In other words, such seal components are not penetrated or otherwise breached by the displaced trolley.

16 Claims, 9 Drawing Sheets

U.S. PATENT DOCUMENTS

| | | | | |
|---|---|---|---|---|
| 6,615,894 | B1 * | 9/2003 | McKeon | 160/1 |
| 7,478,663 | B2 | 1/2009 | Goodman et al. | |
| 2008/0264578 | A1 | 10/2008 | Goodman et al. | |

FOREIGN PATENT DOCUMENTS

| | | | |
|---|---|---|---|
| DE | 29506707 | | 7/1995 |
| EP | 0111962 | A1 | 6/1984 |
| GB | 1226442 | | 3/1971 |
| WO | 2005098189 | A1 | 10/2005 |

OTHER PUBLICATIONS

PCT International Search Report for Application PCT/US2007/083526, dated Oct. 7, 2008.

* cited by examiner

MOVABLE PARTITIONS, COMPONENTS FOR MOVABLE PARTITIONS AND RELATED METHODS

CROSS-REFERENCE TO RELATED APPLICATION

This application claims the benefit under 35 U.S.C. §119(e) of U.S. Provisional Application No. 60/856,676, filed Nov. 3, 2006, the disclosure of which is incorporated by reference herein in its entirety.

TECHNICAL FIELD

The present invention relates to movable partitions and, more particularly, to systems, apparatuses and methods for reducing or eliminating fluid flow across such movable partitions.

BACKGROUND

Movable partitions are utilized in numerous situations and environments for a variety of purposes. Such partitions may include for example, foldable or collapsible doors configured to close-off an opening in order to enclose a room or to subdivide a single large room into one or more smaller rooms. The subdivision of a larger area may be desired, for example, to accommodate the simultaneous meeting of multiple groups. In such applications movable partitions are useful, among other things, for providing privacy and noise reduction.

Movable partitions may also be used to act as a security barrier, a fire barrier or as both. In such a case, the movable partition may be configured to automatically close upon the occurrence of a predetermined event such as the actuation of an associated alarm. For example, one or more movable partitions may be configured as a fire door or barrier wherein each door is formed with a plurality of panels connected to each other by way of hinge mechanisms. The hinged connection of the panels allows the door to fold-up in a compact unit on one side of the opening or it may be stored in a pocket formed within a wall, the pocket being designed to conceal the door and preserve the aesthetics of the room in which the door is installed. When deployment of the door is necessary, the door is driven by a motor along a track (the track often being incorporated into the header above the door), until the leading edge of the door, often defined by a component called the lead post, complementarily engages a mating receptacle. Such a mating receptacle may be referred to as a jamb or a door post when formed in a fixed structure (such as a wall), or as mating lead post when formed in another door or movable partition. The lead post, when properly engaged with the door jamb (or the mating lead post), allows corresponding latching mechanisms to engage if desired, and helps to provide a desired seal (e.g., a seal with respect to airflow, sound waves or both).

However, even when a movable partition is properly closed, due to the various and numerous moving components associated with a movable partition, the movable partition may not always provide the desired level of "seal" from one side of the deployed movable partition to the other. In other words, fluid flow through one or more locations may reduce the effectiveness of the door to act, for example, as a smoke barrier or a sound barrier.

Some efforts have been made to prevent the lateral displacement of the lower edge of such a movable partition to prevent fluid flow beneath the movable partition. For example, U.S. patent application Ser. Nos. 11/097,101 entitled METHOD, APPARATUS, AND SYSTEM FOR DIRECTIONALLY CONTROLLING A MOVABLE PARTITION, 11/796,325 entitled METHOD, APPARATUS AND SYSTEM FOR CONTROLLING A MOVABLE PARTITION, and Provisional Application No. 60/856,957 entitled MOVABLE PARTITIONS WITH LATERAL RESTRAINT DEVICES AND RELATED METHODS (the disclosures of each of which are hereby incorporated by reference in their entireties) discuss various means of reducing or preventing the lateral displacement of the lower edge of a movable partition.

However, even if the lower edge of a movable partition is restrained, "leaks" across the partition may still occur at various locations. In certain circumstances, such "leaks" may individually represent a relatively small flow of air or other fluid across the partition, but the cumulative effect of such leaks can be deleterious to the performance of the partition regardless of whether the partition is being used, for example, as a smoke barrier or a sound barrier.

Reduction in fluid flow across a partition, such as a movable partition used as, for example, a fire, smoke, security or sound barrier in order to make such apparatuses and systems more effective and more efficient is a continued pursuit of the industry.

BRIEF SUMMARY OF THE INVENTION

The present invention is directed to movable partitions, components for movable partitions, systems including movable partitions and related methods. In accordance with one embodiment of the present invention, a track and trolley system for a movable partition is provided. The system may include a track having a central channel extending longitudinally therethrough, a first outer channel located on a first lateral side of the central channel and a second outer channel located on a second lateral side of the central channel. One or more rollers may be coupled to a frame member. The frame member and the roller or rollers may each be disposed in the central channel and longitudinally displaceable relative to the track.

Additionally, the track and trolley system may be configured such that the central channel defines a pathway for a drive chain and such that the frame member and the roller or rollers are located and configured to avoid interference with the pathway.

In accordance with another embodiment of the present invention, a track for a movable partition is provided. The track may include a structure having at least one elongated channel formed therein and defining a longitudinally extending opening in a surface of the structure. A first seal component may have a seal lip that extends at least partially across the opening in a first lateral direction. A second seal component may further have a seal lip extending at least partially across the opening in a second lateral direction. The seal components may be configured such that their respective seal lips are contiguous with one another or such that they laterally overlap.

In accordance with yet another embodiment of the present invention, a movable partition is provided. The movable partition may include a track having at least one elongated channel formed therein and defining a longitudinally extending opening in a surface of the channel. A first seal component may include a seal lip that extends at least partially across the opening in a first lateral direction and a second seal component may have a seal lip that extends at least partially across the opening in a second lateral direction. A plurality of panels is hingedly coupled to one another to form a plicated structure and at least one pin is coupled to at least one panel of the plurality of panels. The pin may extend from the at least one panel, through the opening and into the at least one elongated channel. At least one roller may be coupled to the at least one pin and disposed in the at least one elongated channel.

In another embodiment of the movable partition, at least one channel may include a first channel and a second channel with a central channel being located between the first channel and the second channel. The movable partition may further include a trolley including a frame member having a web member, a first leg on a first side of the web member and a second leg member on a second side of the web member. A first roller may be coupled to the first leg and a second roller may be coupled to the second leg. The frame member, the first roller and the second roller may each be disposed in the central channel and longitudinally displaceable relative to the track.

In accordance with yet another embodiment of the present invention, another movable partition is provided. The partition includes a first plicated structure having a plurality of hingedly coupled panels and a second plicated structure having a plurality of hingedly coupled panels. A track includes a central channel extending longitudinally therethrough, a first outer channel located on a first lateral side of the central channel and a second outer channel located on a second lateral side of the central channel. The first plicated structure is associated with the first outer channel and the second plicated structure is associated with the second outer channel. A trolley comprising a frame member and at least one roller coupled to the frame member are disposed in the central channel and longitudinally displaceable relative to the track.

In accordance with a further embodiment of the present invention, another movable partition is provided. The movable partition includes a plurality of panels hingedly coupled to one another to form a plicated structure. A layer of insulation is disposed on a surface of the plicated structure and at least one fastening apparatus is coupled to at least one panel of the plurality of panels, the at least one fastening apparatus being located and configured to substantially fix the layer of insulation relative to the plicated structure. A layer of sealant is configured and located to substantially fluidly seal the layer of insulation and the plurality of panels.

In accordance with yet another embodiment of the present invention, a method of operating a movable partition is provided. The method includes suspending a first plicated structure having a plurality of panels from a first channel of a track and suspending a second plicated structure having a plurality of panels from a second channel of the track. A trolley is at least partially disposed in a third channel of the track, wherein the third channel of the track is disposed between the first and second channels. A first fluid seal is substantially formed between the first plicated structure and a surface above the first plicated structure and a fluid seal is substantially formed between the second plicated structure and a surface above the second plicated structure. The trolley is longitudinally displaced along the track while the trolley is maintained within an envelope defined by the first fluid seal and the second seal.

Various other embodiments of the invention are described herein and will become apparent to one of ordinary skill in the art upon reading of the detailed description.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
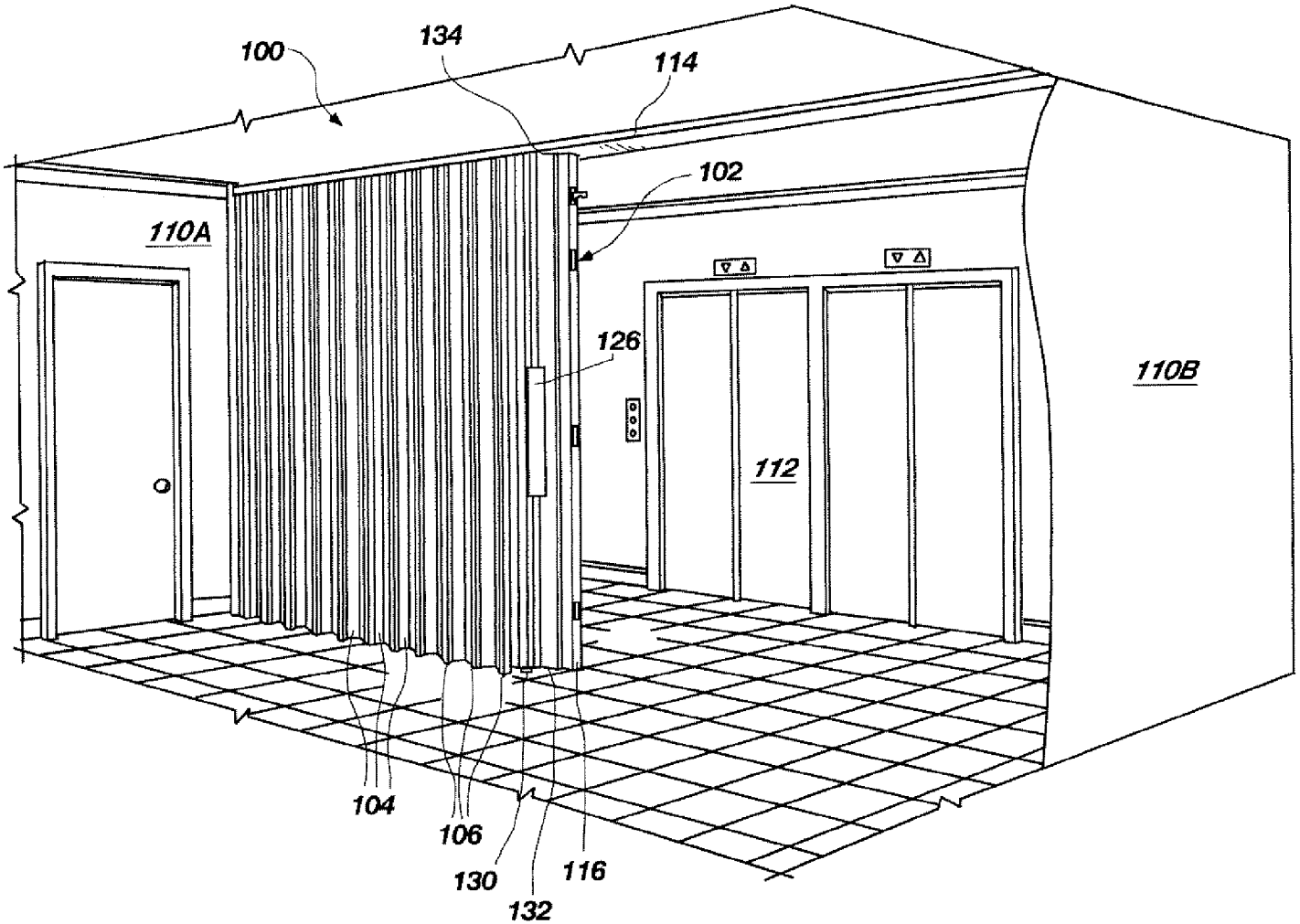
FIG. 1 is a perspective view of a system and movable partition in accordance with an embodiment of the present invention.
Figure 2:
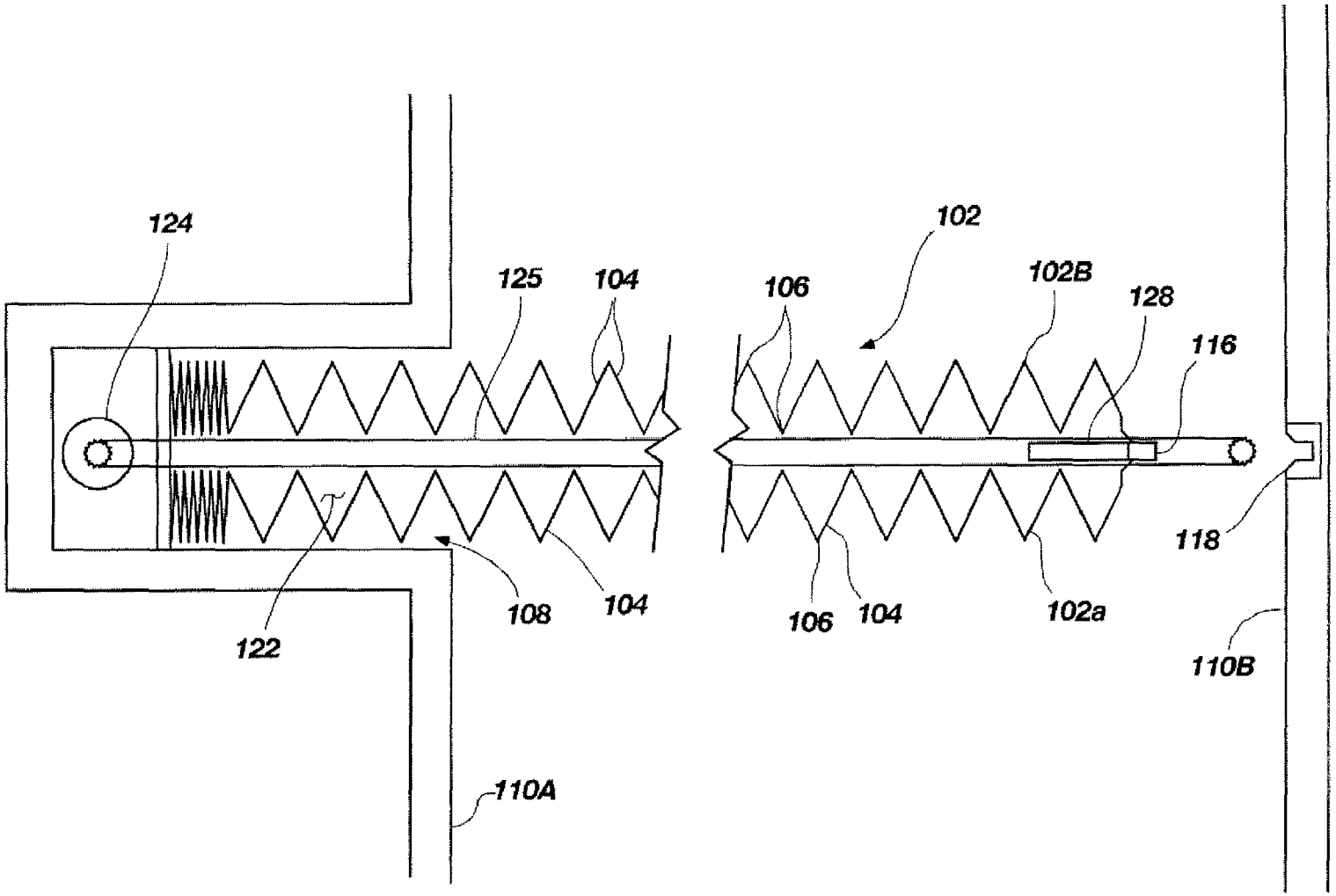
FIG. 2 is a plan view of the partition shown in FIG. 1.
Figure 3:
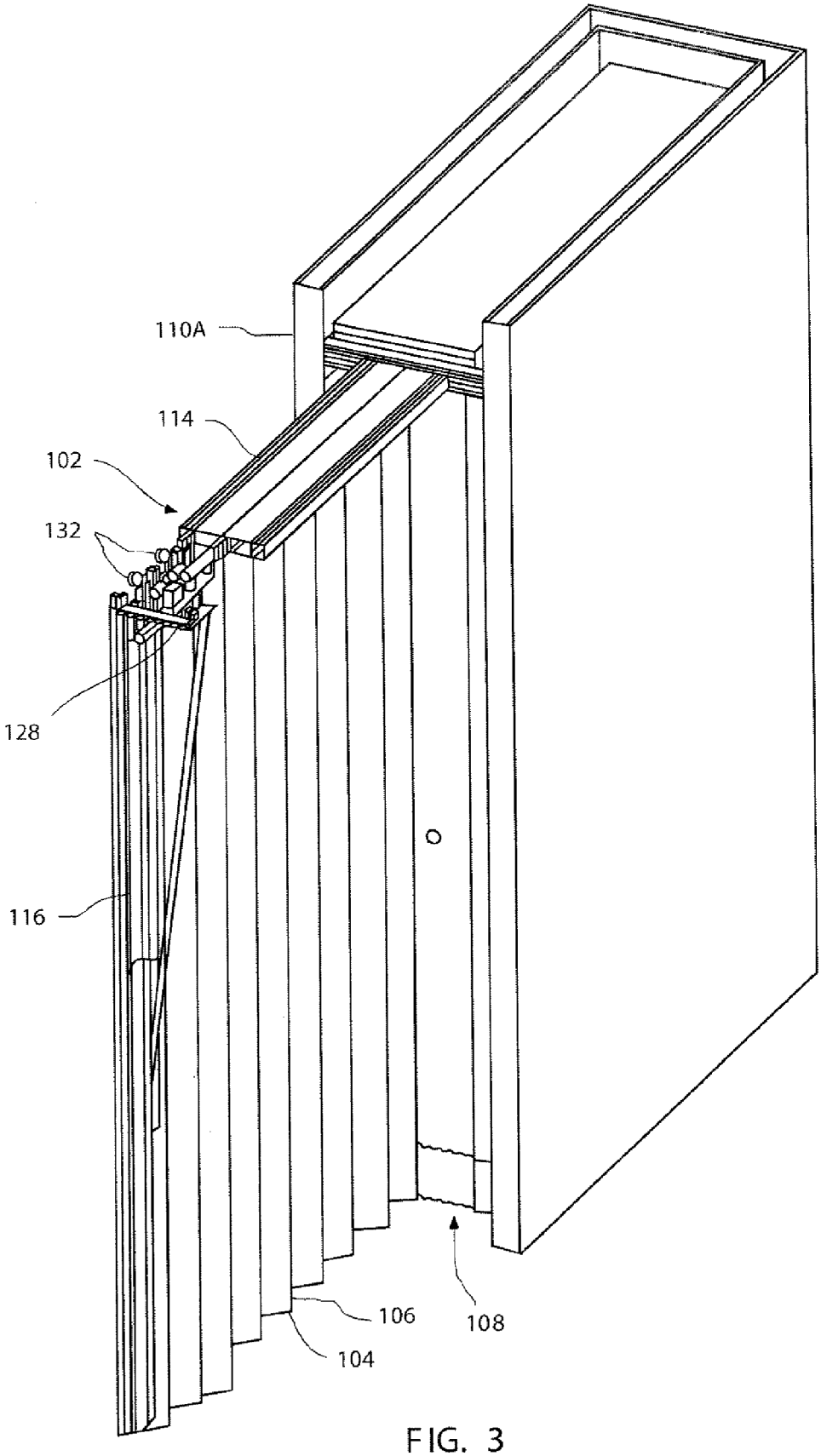
FIG. 3 a perspective view of a movable partition shown in FIGS. 1 and 2 with various components and sections stripped away to show certain details in accordance with an embodiment of the present invention.

Referring to FIGS. 1 through 3, a system 100 is shown which includes a movable partition, for example, in the form of an accordion-type door 102. The door 102 may be used, for example, as a security and/or fire door. In other embodiments, the door 102 need not be utilized as a fire or security door, but may be used, for example, for the subdividing of a larger space into smaller rooms or areas or it may be used as a sound barrier. The door 102 may be formed with a plurality of panels 104 that are connected to one another with hinges 106 or other hinge-like members. The hinged connection of the individual panels 104 enables the panels 104 to fold relative to each other in an accordion or a plicated manner such that the door 102 may be compactly stored in a pocket 108 formed in a wall 110A of a building when in a retracted or folded state.

When it is desired to deploy the door 102 to an extended position, for example, to secure an area such as an elevator lobby 112 during a fire, the door 102 is displaced along a track 114 and across the space to provide an appropriate barrier. When in a deployed or an extended state, a leading edge of the door 102, shown as a male lead post 116, complementarily or matingly engages with a jamb or door post 118 (FIG. 2) that may be formed in a wall 110B of a building. As can be seen in FIG. 2, an accordion-type door 102 may include a first accordion-style partition 102A and a second accordion-style partition 102B which is laterally spaced from the first partition 102A (it is noted that only one panel is shown in FIG. 3 for purposes of convenience and clarity in describing embodiments of the invention). Such a configuration may be utilized, for example, as a fire door wherein one partition 102A may act as a primary fire and smoke barrier, the space 122 between the two partitions 102A and 102B may act as an insulator or a buffer zone, and the second partition 102B may act as a secondary fire and smoke barrier. Such a configuration may also be useful in providing an acoustical barrier when the door 102 is used to subdivide a larger space into multiple, smaller rooms.

Figure 4:
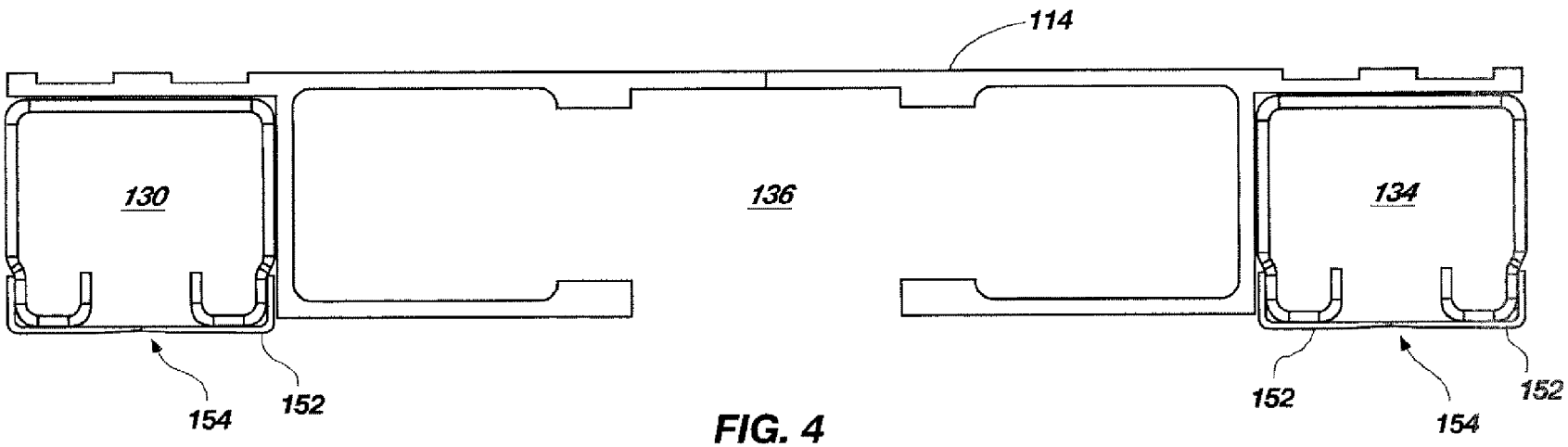
FIG. 4 is an end view of an overhead track used in certain embodiments of the present invention.

A drive, which may include, for example, a motor 124 and a transmission member such as a drive belt or chain 125 (FIG. 2), may be configured to open and close the door 102 upon actuation thereof. A trolley 128 is coupled to a portion of the chain 125 and configured to ride or slide along the track 114. The trolley 128 may be coupled to, for example, the lead post 116 such that displacement of the trolley 128 results in corresponding displacement of the lead post 116 and the various panels 104 attached thereto. Referring briefly to FIG. 4, an end view of a track 114 is shown which may be used in accordance with an embodiment of the present invention. A first channel 130 may be configured for receipt of slide mechanisms or rollers 132 (FIGS. 3 and 7) that may be attached to individual panels 104 associated with a first partition (e.g., partition 102A) while a second channel 134 may be configured for receipt of similar slide mechanisms or rollers associated with a second partition (e.g., partition 102B). A central channel 136 may be disposed between the two partition channels 130 and 134 and may be configured for receipt of the trolley 128 as well as provide a raceway for the belt or chain 125.

Referring back to FIGS. 1 through 3, the door system 100 may further include various sensors and switches to assist in the control of the door 102 through appropriate connection with the motor 124 (such as by way of an appropriate controller as will be appreciated by those of ordinary skill in the art). For example, as shown in FIG. 1, when used as a fire door, the door 102 may include a switch or actuator 126, commonly referred to as "panic hardware." Actuation of the panic hardware 126 enables a person located on one side of the door 102 to cause the door to open if it is closed, or to stop the door 102 while it is closing, allowing access through the barrier formed by the door 102 for a predetermined amount of time.

It is noted that, while the presently described embodiment is more specifically directed to a single accordion-type door 102, other movable partitions may be utilized. For example, a two-door, or bi-part door, system may be utilized wherein two similarly configured doors extend across a space and join together to form an appropriate barrier. Also, the present invention is applicable to movable partitions or barriers other than the accordion-type doors that are specifically shown and described herein.

Figure 5:
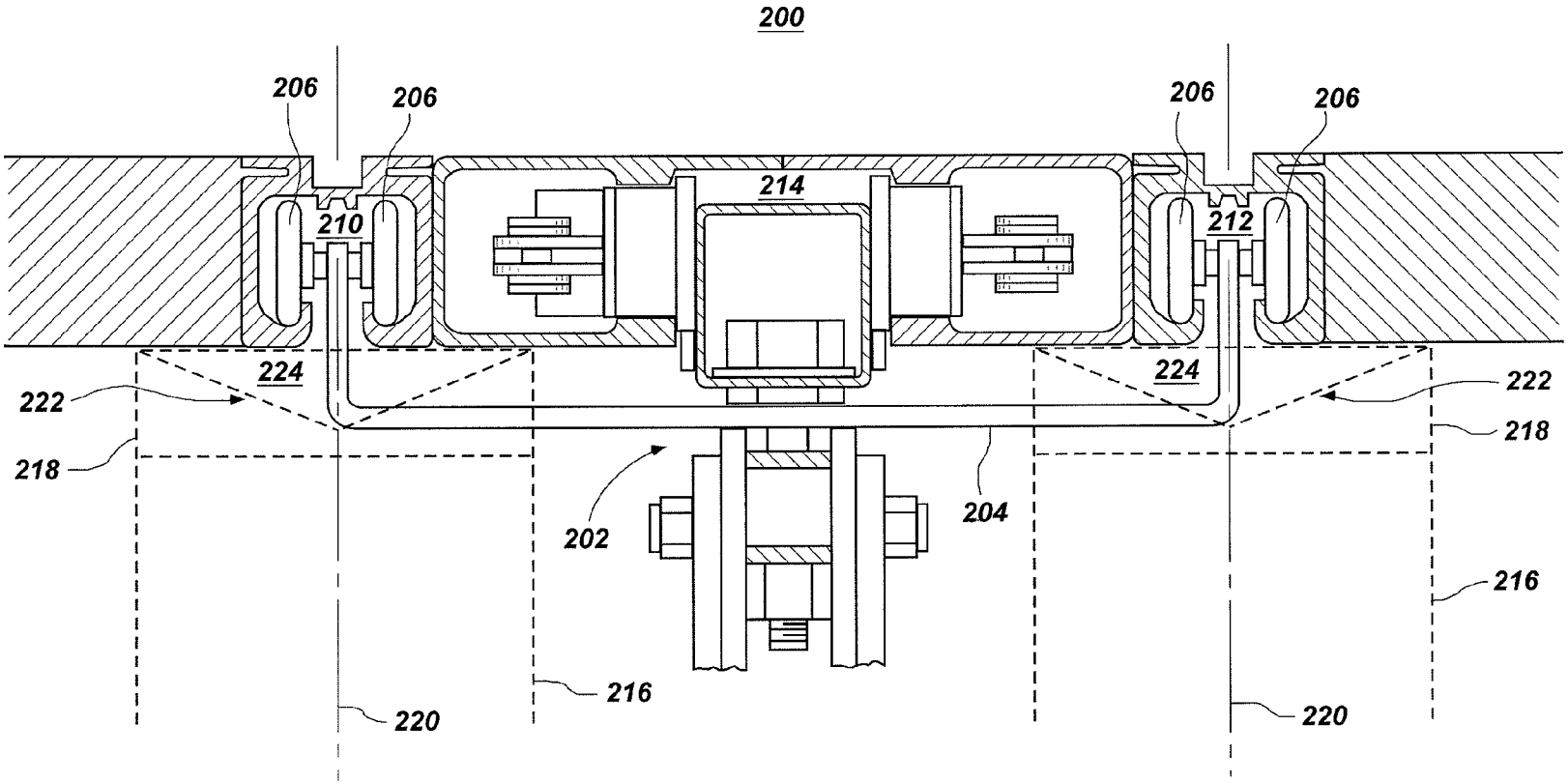
FIG. 5 is a partial cross-sectional view of a prior art device.

Referring briefly now to FIG. 5, a partial cross-sectional view is shown of portions of a prior art device including a track 200 and a trolley 202 for a lead post. FIG. 5 also includes portions that are not part of the prior art device, which are shown in dashed lines. The trolley 202 includes a frame member 204 having rollers 206 coupled to laterally spaced ends thereof. The track 200 includes a central channel 214 in which a portion of the trolley 202 is disposed, and which acts as a raceway for a drive chain (chain not shown in FIG. 5). A first channel 210 is located on a first side of the track 200 and receives a first set of rollers 206 of the trolley 202. A second channel 212 is located on an opposing side of the track 200 and receives a second set of rollers 206 of the trolley 202. The central channel 214 is disposed between the first and second channels 210 and 212 and provides a raceway for a drive belt or drive chain as well as receives a portion of the trolley 202 such as a structure that may be coupled to the drive chain or a structure that may act as a chain (or belt) tensioner or idler.

As also shown FIG. 5, as parts that are not part of the prior art device, but are used to illustrate possible hinged panels 216 (superimposed in dashed lines for purposes of clarity) as they may be used with the prior art device of FIG. 5. In this possible implementation, a flexible seal component 218 is located at the upper portion of the panels and is intended to be in contact with the track 200 and ceiling or other supporting structure to which the track 200 is affixed. However, because the frame member 204 of the trolley extends across the centerline of each the first and second channels 210 and 212, and therefore across the centerline 220 of each pathway of the suspended panels 216, the frame member 204 of the trolley 202 penetrates through the region in which the flexible seal component 218 is disposed and causes the flexible seal to be displaced away from the track 200 (as indicated by dashed lines 222) and creates a significant gap 224 through which fluid flow may occur. The gap 224 allows a certain amount of air, smoke or noise to pass across the partitions 216. In accordance with one embodiment of the present invention, the gaps 224 created by the prior device are substantially reduced or eliminated to improve the ability to seal a door and prevent, or at least minimize, fluid flow from one side of the door to the other.

Figure 6:
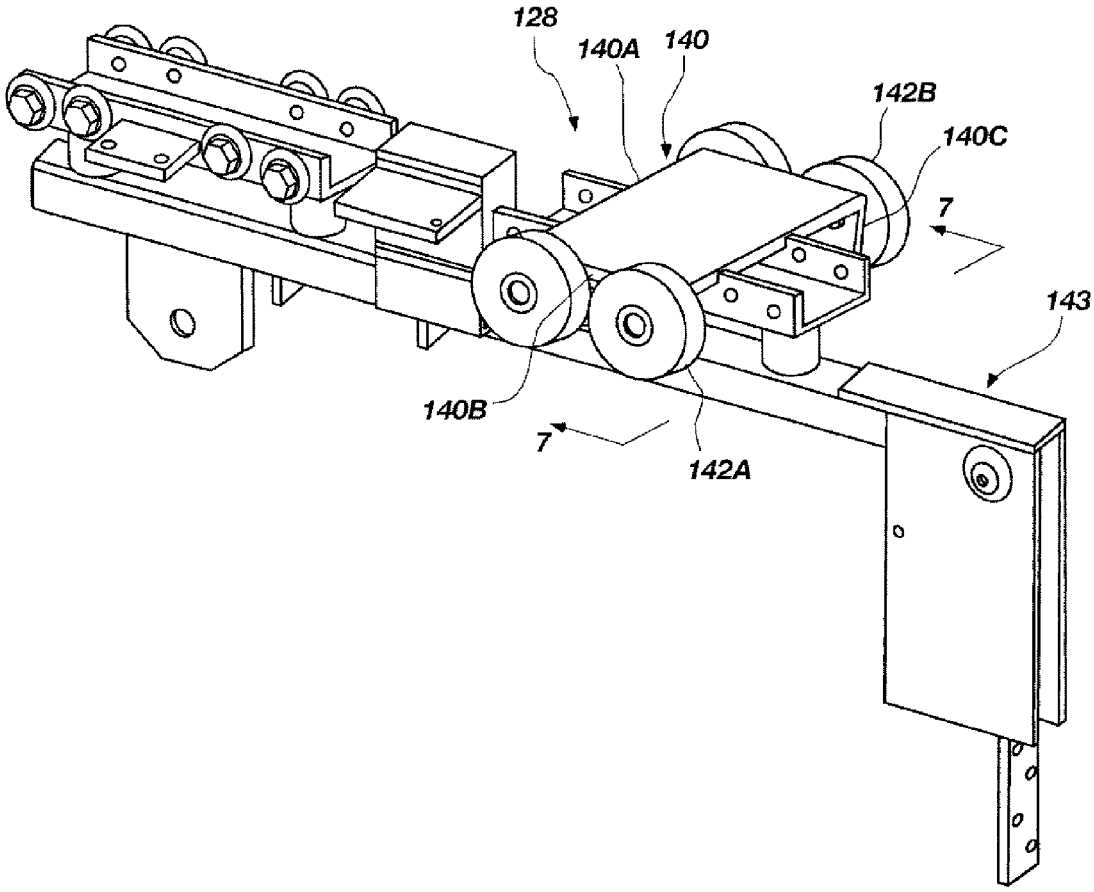
FIG. 6 is a perspective view of a trolley in accordance with an embodiment of the present invention.
Figure 7:
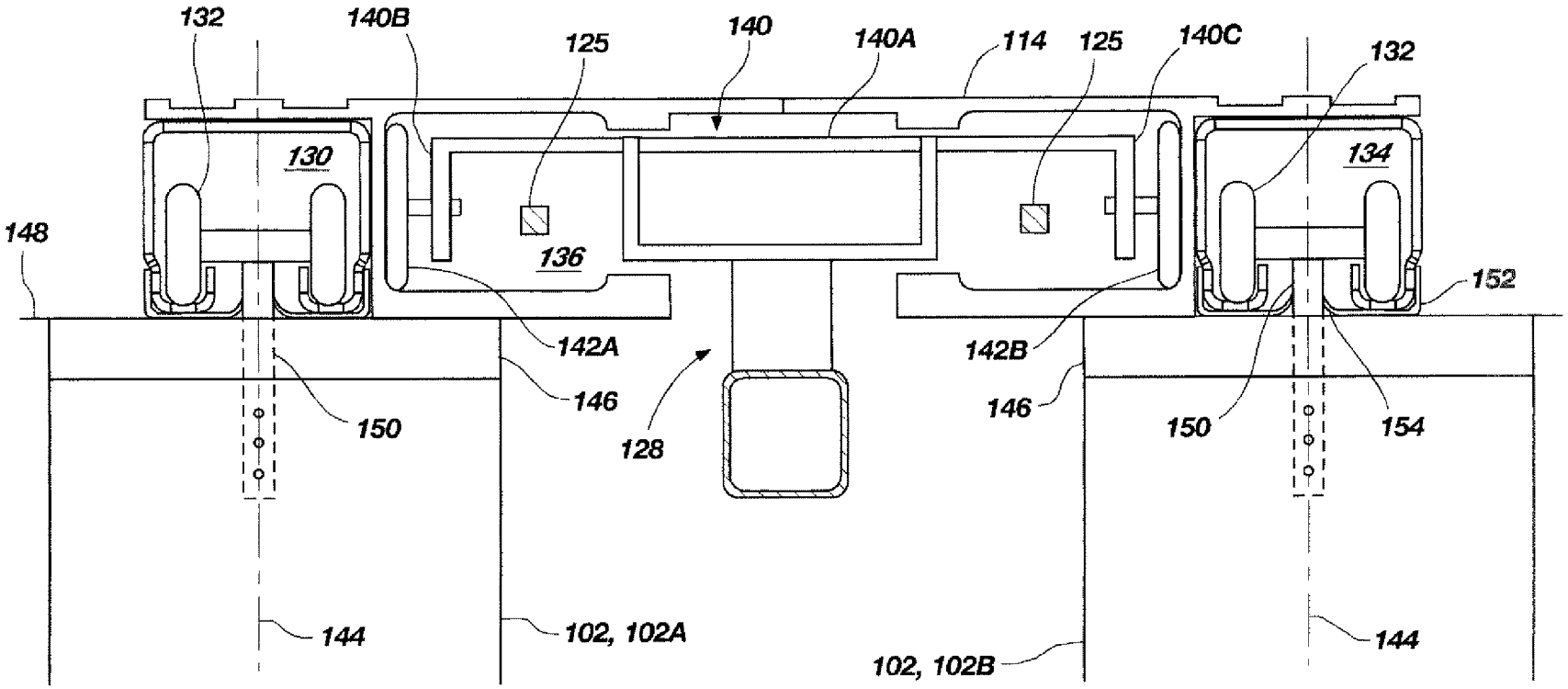
FIG. 7 is a partial cross-section view of an overhead track and a trolley in accordance with an embodiment of the present invention.

Referring now to FIGS. 6 and 7 (with general reference to FIGS. 1 through 4), an embodiment of the present invention is shown regarding a track 114 and trolley 128 arrangement. The trolley 128 may include a frame member 140 having a web portion 140A and two downwardly extending leg portions 140B and 140C. One or more rollers 142A may be coupled to the first leg portion 140B and one or more rollers 142B may be coupled to the second leg portion 140C. It is noted that, in the embodiment depicted by FIGS. 6 and 7, the frame member 140 is oriented and configured substantially opposite to that of the prior art device described with respect to FIG. 5. In other words, the legs of the frame member used in the prior art device extended substantially upward from the web member of the frame in contrast with the embodiment described with respect to FIGS. 6 and 7. While the orientation described with respect to FIGS. 6 and 7 may provide certain advantages, the prior art orientation may also be utilized in conjunction with the present invention.

When installed in the track 114, the rollers 142A and 142B are disposed in the central channel 136 of the track 114. This is in contrast with the prior art device which was configured such that the rollers associated with the frame member were disposed in the laterally outward partition channels and not in the central channel. By configuring the frame member 140 and the associated rollers 142A and 142B such that the rollers 142A and 142B are located within the central channel 136, there is no structural member or other component of the trolley 128 that extends beyond the centerline 144 of either of the first or second channel 130 and 134 (and, thus, of the corresponding centerline path of each partition 102A and 102B or individual panels 102 thereof).

Because there are no components extending through the centerline 144, the flexible seal components 146 located at the top of the panels 102 remain in substantial contact with the track 128 and the ceiling 148 or other structure in which the track 128 may be installed, eliminating the gaps created by the prior art device previously described with respect to FIG. 5.

It is further noted that the embodiment shown and described with respect to FIGS. 6 and 7 still maintains the ability for the chain 125 (or drive belt) to pass through the channel 136 without interference with the trolley 128. Additionally, the reduced width of the frame member 140 and corresponding positioning of the rollers 142A and 142B (or sliding structures or other mechanisms) provides increased stability to the lead post 116 which is attached to the trolley 128 (e.g., by way of frame components 143) due to the reduced bending of the frame member 140 and corresponding lateral displacement of the lead post 116. Indeed, the configuration of the trolley 128 in conjunction with its cooperative positioning within the central channel 136 of the track 114 enables the trolley to support a greater load as compared to the previously described prior art device.

Referring briefly back to FIG. 4 in conjunction with FIG. 7, another embodiment of the present invention is shown and described. As already described, a number of the panels 102 of the partitions 102A and 102B (in some embodiments, all of them) have rollers 132 or slide mechanisms attached to them to support them from the first and second channels 130 and 134 of the track 114. The rollers 132 may be coupled to the panels 104 by way of a pin 150 or other similar structure fastened to the panel 102. The pins 150, since they extend between the panels 102 and the channels 130 and 134 in which the associated rollers 132 are disposed, provide another point of potential leakage or fluid flow across the partitions 102A and 102B of the door 102. Because each panel 102 straddles the centerline 144 of an associated channel 130 and 134 from which they are supported, fluid flow may occur from a location exterior to the partition (e.g., partition 102A), into the associated channel (e.g., 130) and into the space 122 (FIG. 2) between the two partitions 102A and 102B. Fluid flow may then occur across the other partition (e.g., partition 102B) in a similar manner.

Figure 8:
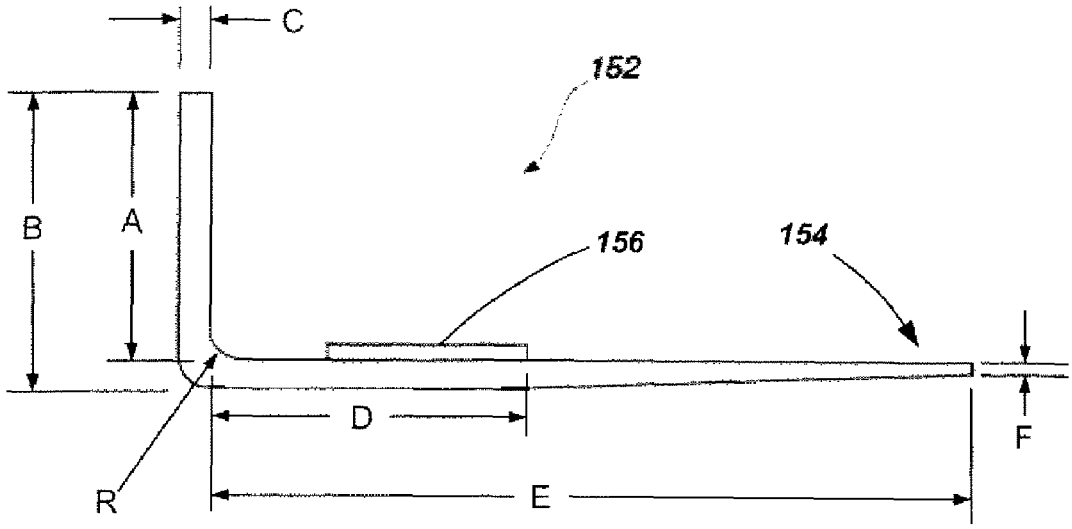
FIG. 8 is an end view of a seal component in accordance with an embodiment of the present invention.

In one embodiment of the present invention, seal components 152 are installed in association with the channels 130 and 134 of the track 114 to further reduce fluid flow across the door 102. Referring briefly to FIG. 8, an example of a seal component 152 is shown. The seal component 152 may include an L-shaped component, such as shown, or may exhibit various other cross-sectional configurations. Example dimensions of a seal component 152 according to one embodiment include the following: dimension A may be approximately 0.335 inch (approximately 8.5 millimeters (mm)); dimension B may be approximately 0.375 inch (approximately 9.5 mm); dimension C may be approximately 0.04 inch (approximately 1 mm); dimension D may be approximately 0.4 inch (approximately 10 mm); dimension E may be approximately 0.963 inch (approximately 24 mm); dimension F may be approximately 0.015 inch (approximately 0.04 mm) and R may be approximately 0.04 inch (approximately 1 mm). However, such dimensions are merely examples and it will be appreciated by those of skill in the art that other configurations may be utilized. The seal component 152 includes a seal lip 154 which is substantially flexible and is substantially elastically deformable. In one embodiment, such a seal component may be formed of a material such as polyvinylchloride (PVC), although other materials may be utilized.

As seen in FIG. 4, two such seal components may be utilized in conjunction with a channel (e.g., channel 130) with the seal lips 154 of each seal component being substantially contiguous with each other or even overlapping each other by a desired dimension. The seal components 152 may be installed, for example, using an adhesive material 156 (FIG. 8) disposed between the seal component 152 and the track 114.

The pins 150 associated with the panels 104 protrude through the seal formed by the seal components 152 causing the seal lips 154 to deflect as indicated in FIG. 7. The seal components 152 substantially wrap around the pins 150 and, when the pins 150 are displaced along the track (such as when the door 102 is deployed or retracted), the seal lips 154 return to their normal position such as shown in FIG. 4 in the absence of such pins 150. Thus, the seal components 152 serve to minimize fluid flow that may otherwise occur across a partition (e.g., 102A) by way of the associated channel (e.g., channel 130).

Figure 9:
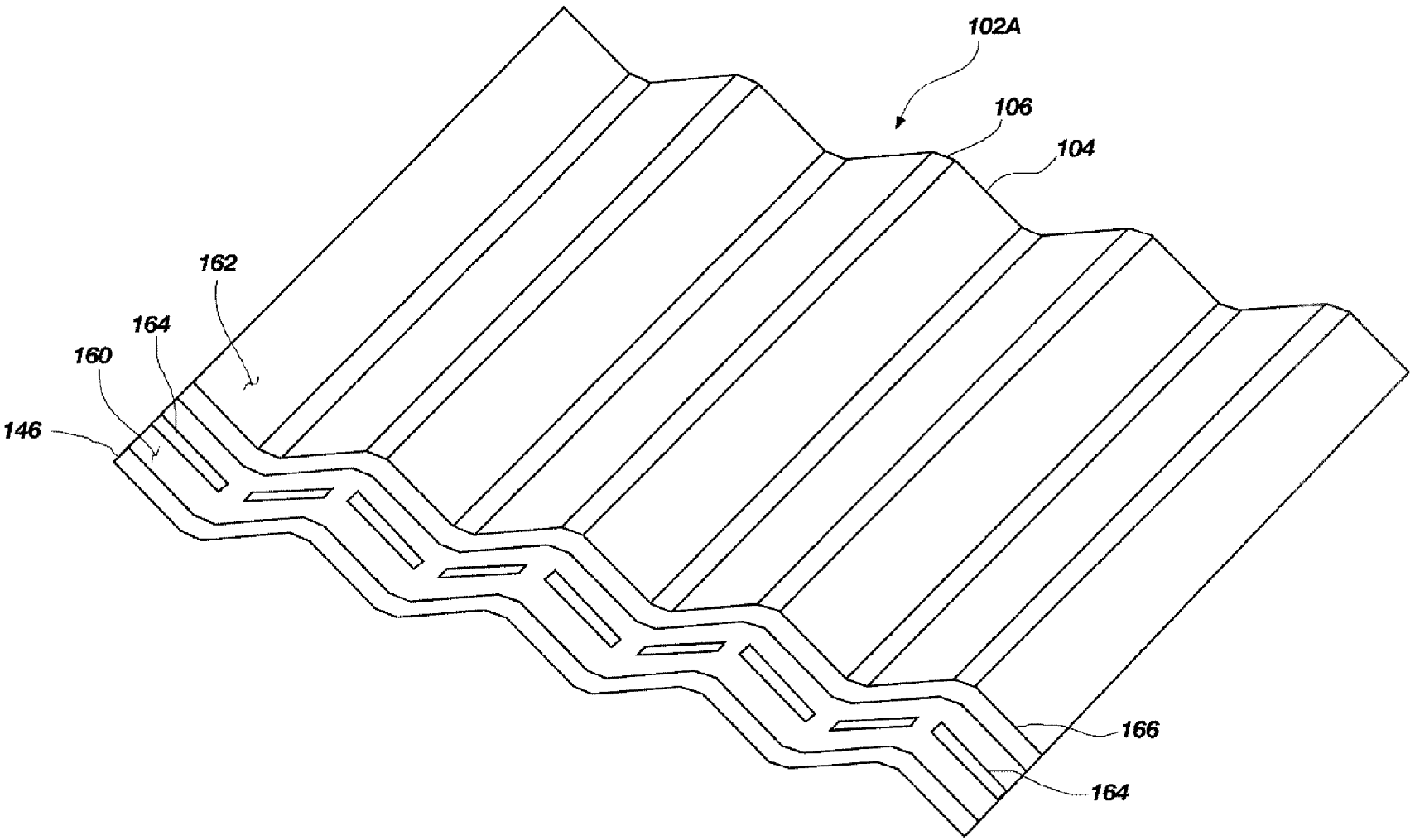
FIG. 9 is a perspective view of the inside surface of a set of panels used to form a movable partition in accordance with an embodiment of the present invention.

Referring now to FIG. 9, another embodiment of the present invention is shown and described. One or more layers of insulation 160 may be disposed on or adjacent an inner surface 162 of the partition 102A (i.e., the surface of the partition located within the space 122 of the door 102). For example, a layer of fiberglass insulation 160 having a foil backing may be installed near the upper edge of the partition 102A. Clips 164 or other fasteners may be used to fix the insulation 160 in place relative to the panels 104. However, even with the clips 164 or other fasteners holding the insulation 160 in place, fluid flow may occur along a path traveling between the insulation 160 and the individual panels 104. To prevent or minimize such fluid flow, a sealant, such as a foil tape 166 may be placed over an edge of the insulation 160 and also adhered to the inner surface 162 of the partition 102A. Other means of sealing may likewise be used to form a seal between the insulation 160 and the inner surface of the partition 102A.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition comprising:

a first plicated structure having a plurality of hingedly coupled panels;

a second plicated structure having a plurality of hingedly coupled panels the first and second plicated structures having movable leading edges;

a track having a central channel extending longitudinally therethrough, a first outer channel located on a first lateral side of the central channel and a second outer channel located on a second lateral side of the central channel, wherein the first plicated structure is associated with the first outer channel and wherein the second plicated structure is associated with the second outer channel; and a trolley comprising a frame member and at least one roller coupled to the frame member adjacent the movable leading edges, wherein the frame member and the at least one roller are each disposed in the central channel and longitudinally displaceable relative to the track.

2. The movable partition of claim 1, further comprising at least one of a roller and a sliding member disposed in an interior portion of the first outer channel and coupled with at least one of the plurality of panels of the first plicated structure.

3. The movable partition of claim 2, further comprising at least one of a roller and a sliding member disposed in an interior portion of the second outer channel and coupled with at least one of the plurality of panels of the second plicated structure.

4. The movable partition of claim 1, wherein the frame member includes a web member, a first leg on a first side of the web member and a second leg member on a second side of the web member, and wherein the at least one roller includes at least a first roller coupled to the first leg, and at least a second other roller coupled to the second leg.

5. The movable partition of claim 4, wherein the central channel defines a passageway for a drive chain and wherein the frame member, the at least one roller and the at least one other roller are located and configured to avoid interference with the passageway.

6. The movable partition of claim 5, wherein at least one of the first outer channel and the second outer channel define a longitudinally extending opening in a surface thereof, and wherein the system further comprises a first seal component having a seal lip extending at least partially across the opening in a first lateral direction; and a second seal component having a seal lip extending at least partially across the opening in a second lateral direction.

7. The movable partition of claim 6, wherein the first seal lip and the second seal lip are contiguous.

8. The movable partition of claim 7, further comprising at least one pin member extending between the at least one of a roller and a sliding member and the panel to first plicated structure, the pin member extending past and effecting deflection of the first seal lip and the second seal lip.

9. The movable partition of claim 8, further comprising:

a layer of insulation disposed on a surface of the first plicated structure;

at least one fastening member coupled to at least one panel of the plurality of panels of the first plicated structure, the at least one fastening member being located and configured to substantially fix the layer of insulation relative to the first plicated structure; and a layer of sealant configured and located to substantially form a fluid seal between the layer of insulation and the plurality of panels.

10. The movable partition of claim 6, wherein the first seal lip laterally overlaps the second seal lip.

11. A method of operating a movable partition, the method comprising:

suspending a first plicated structure having a plurality of panels from a first channel of a track substantially along a first plane extending through the first channel;

suspending a second plicated structure having a plurality of panels from a second channel of the track substantially along a second plane extending through the second channel;

disposing a trolley at least partially within a third channel of the track and between the first and second channels the trolley having at least one roller located adjacent a movable leading edge of the plicated structures;

substantially forming a first fluid seal between the first plicated structure and a surface above the first plicated structure;

substantially forming a second fluid seal between the second plicated structure and a surface above the second plicated structure; and longitudinally displacing the trolley along the track while maintaining the trolley within an envelope defined by the first fluid seal and the second fluid seal.

12. The method according to claim 11, further comprising coupling a portion of the trolley to a lead post and coupling the lead post to both the first plicated structure and the second plicated structure.

13. The method according to claim 11, further comprising:

disposing a first seal component adjacent a longitudinally extending opening of the first channel and orienting a seal lip of the first seal component to extend at least partially across the longitudinally extending opening in a first lateral direction; and disposing a second seal component adjacent the longitudinally extending opening and orienting a seal lip of the second seal component to extend at least partially across the longitudinally extending opening in a second lateral direction.

14. The method according to claim 13, further comprising:

disposing at least one of a roller and a sliding member in an interior portion of the first channel;

coupling at least one pin to the at least one of a roller and a sliding member;

extending the at least one pin through the opening of the first channel and past the first and second seal components;

coupling the at least one pin to the first plicated structure; and longitudinally displacing the at least one pin substantially concurrently with longitudinally displacing the trolley along the track.

15. The method according to claim 11, further comprising:

disposing a layer of insulation on a surface of the first plicated structure; and substantially forming a seal between the layer of insulation and the first plicated structure.

16. The method according to claim 15, wherein substantially forming a seal between the layer of insulation and the first plicated structure further includes adhesively securing the layer of insulation to the surface of the first plicated structure.

* * * * *

UNITED STATES PATENT AND TRADEMARK OFFICE

CERTIFICATE OF CORRECTION

PATENT NO. : 7,845,386 B2
APPLICATION NO. : 11/934555
DATED : December 7, 2010
INVENTOR(S) : Coleman et al.

It is certified that error appears in the above-identified patent and that said Letters Patent is hereby corrected as shown below:

On the title page:

In ITEM [74] *Attorney, Agent, or Firm*—: change "TaskBritt" to --TraskBritt--

In the specification:

| | | |
|---|---|---|
| COLUMN 5, | LINE 62, | change "shown" to --shown in-- |
| COLUMN 6, | LINE 12, | change "partitions" to --panels-- |

Signed and Sealed this
Seventeenth Day of December, 2013

Margaret A. Focarino

Margaret A. Focarino
*Commissioner for Patents of the United States Patent and Trademark Office*